US005105601A

United States Patent [19]

Horiguchi et al.

[11] Patent Number: 5,105,601

[45] Date of Patent: Apr. 21, 1992

[54] FEEDER OF WRAPPING PAPER FOR COIN WRAPPING MACHINE

[75] Inventors: Nobushige Horiguchi, Kitamoto; Yasuaki Kaneko, Fukuoka; Shoichi Uda, Tokyo, all of Japan

[73] Assignee: Laurel Bank Machines Co., Ltd., Tokyo, Japan

[21] Appl. No.: 534,655

[22] Filed: Jun. 7, 1990

[30] Foreign Application Priority Data

Jun. 8, 1989 [JP] Japan ..... 1-66881[U]
Jun. 8, 1989 [JP] Japan ..... 1-66882[U]

[51] Int. Cl.[5] ..... B65B 11/04; B65B 57/04

[52] U.S. Cl. ..... 53/465; 53/64; 53/212; 53/389.4

[58] Field of Search ..... 53/64, 212, 389, 587, 53/465, 389.2, 389.3, 389.4; 242/68.3, 75.45, 75.51, 75.52, 105

[56] References Cited

U.S. PATENT DOCUMENTS

| | | | |
|---|---|---|---|
| 2,149,444 | 3/1939 | Kohlmann | 53/212 X |
| 2,466,950 | 4/1949 | Hillmer | 242/68.3 |
| 2,859,921 | 11/1958 | Bowen | 242/75.45 |
| 3,243,138 | 3/1966 | Nilsson | 242/75.45 |
| 3,720,385 | 3/1973 | Staats | 242/75.45 |
| 3,755,861 | 9/1973 | Castro | 242/75.52 X |
| 4,160,195 | 7/1979 | Sakamato | 242/75.52 |
| 4,313,288 | 2/1982 | Tassi | 53/389 |
| 4,554,775 | 11/1985 | Asami | 53/212 |
| 4,578,928 | 4/1986 | Petterson | 53/587 X |
| 4,729,211 | 3/1988 | Sakurai | 53/389 X |
| 4,835,938 | 6/1989 | Sakurai | 53/212 |

FOREIGN PATENT DOCUMENTS

| | | | |
|---|---|---|---|
| 1040632 | 10/1958 | Fed. Rep. of Germany | 242/68.3 |
| 1263443 | 3/1968 | Fed. Rep. of Germany | 242/75.52 |

OTHER PUBLICATIONS

"Service Manual", marketed by Brand Inc. as Model 1801.

*Primary Examiner*—John Sipos
*Attorney, Agent, or Firm*—Fleit, Jacobson, Cohn, Price, Holman & Stern

[57] ABSTRACT

A feeder of wrapping paper is located adjacent to a coin wrapping machine. The feeder comprises a frame, a turntable rotatably mounted on the frame, a motor positioned within the frame for rotating the turntable, guide plates for guiding the wrapping paper along a predetermined path, and a controller for controlling the operation of the motor. The turntable forms a substantially horizontal plane on which an operator can place a roll of the wrapping paper and is provided with a plurality of opening areas for accommodating the operator's fingers supporting a lower side surface of the roll. The controller controls the operation of the motor in association with a feed roller constituting a wrapping device of the coin wrapping machine. The roll of wrapping paper on the turntable is rotated with the rotation of the turntable by the motor so as to deliver the wrapping paper in association with the feed roller.

18 Claims, 5 Drawing Sheets

FEEDER OF WRAPPING PAPER FOR COIN WRAPPING MACHINE

BACKGROUND OF THE INVENTION

The present invention relates to a feeder of wrapping paper for a coin wrapping machine, and more particularly, to such a feeder which can feed a wrapping paper smoothly from a roll thereof having a large diameter to the coin wrapping machine and can facilitate the work of replacing the roll with a new roll of wrapping paper.

DESCRIPTION OF THE PRIOR ART

A coin wrapping machine is known which stacks a plurality of coins in the form of a cylinder or roll and winds a wrapping paper around the stacked coins to package them.

U.S. Pat. Nos. 4,835,938 and 4,729,211 disclose this kind of coin wrapping machine, and as schematically shown in FIG. 6, a coin wrapping machine 1 comprises a hopper 2 into which coins are thrown, a discriminating and counting device 3 which discriminates only a predetermined denomination of coins from the other coins among the coins thrown into the hopper 2 and which counts and successively delivers the discriminated coins; a stacking device 4 which stacks the coins delivered from the discriminating and counting device 3 to make a stack of a predetermined number of coins in the form of a cylinder roll, a wrapping device 5 which winds a wrapping paper around the stack of coins made by the stacking device 4 to wrap the stack in the paper and which delivers the wrapped coins, that is, a roll of coins, through a chute 6, and a control unit (not shown) which controls the operation of these devices, that is, the discriminating and counting device 3, the stacking device 4, and the wrapping device 5. And these devices are included in a housing 7 as shown in phantom lines.

The discriminating and counting device 3 has a rotatable disc 12 which receives the coins thrown through the hopper 2 on its upper side surface. The rotatable disc 12 is adapted to be rotated for transferring the coins circumferentially and outwardly by the centrifugal force caused by its rotation and is provided with a thickness limiting member 12*a*, which permits only the coins having a thickness smaller than a predetermined thickness to pass successively therethrough, thereby taking out only such coins. The discriminating and counting device 3 also has a coin discriminating passageway 13 and a conveyor belt 13*a*. The coin discriminating passageway 13 is arranged to guide only the coins having a diameter larger than a predetermined diameter, and the conveyor belt 13*a* is adapted to take over the coins which have been delivered from the rotatable disc 12 and conveys them along the coin discriminating passageway 13. The discriminating and counting device 3 further includes a count sensor (not shown) for counting the coins guided and conveyed along the coin discriminating passageway 13, and a stop (not shown) for temporarily blocking the coins when a predetermined number thereof has been counted.

The stacking device 4 has a pair of stacking drums 14, 14, which are adjustable in the clearance therebetween in accordance with the denomination of the coins and adapted to be driven in rotation about their vertical axes in opposite directions relative to each other. On outer peripheral surface of each of the stacking drums 14, 14, there is provided a spiral guide 14*a*, which supports the coins delivered through the discriminating and counting device 3 with the coins being stacked vertically. Further, the stacking device 4 is arranged to rotate the stacking drums 14, 14 by the angle required for the coin denomination every time when one of the coins is fed to the spiral guides 14*a*, 14*a*. Therefore, the portion of each of the spiral guides 14*a*, 14*a* supporting the coins is lowered gradually and, thereby, the stacking device 4 allows the spiral guides 14*a*, 14*a* to be lowered intermittently so that the upper end of the stack thereon is normally positioned on a level with the upper surface of the coin discriminating passageway 13. When the predetermined number of coins has been thus stacked, the stacking device 4 allow the stack to be lowered onto a shutter 15.

The wrapping device 5 includes wrapping rollers 16, 16, 16, which are rotated about their vertical axes and are adjustable in the clearance therebetween in accordance with the denomination of the coins to be wrapped, and a coin carrier 17 which is moved upwardly and downwardly in a space among the wrapping rollers 16, 16, 16 so as to receive the stack falling through the shutter 15 upon its opening and to guide the stack to the wrapping position. The wrapping device 5 also includes a feed roller 18 which is rotated about its vertical axis and which feeds a wrapping paper withdrawn from a roll of wrapping paper, namely a paper roll 10 between the wrapping rollers 16, 16, 16 and the stack located in the wrapping position; an idler roller 19 which is disposed to cooperate with the feed roller 18 to grasp the wrapping paper 11; a cutter 20 which can cut the wrapping paper at a desired place thereof when the wrapping paper 11 has been fed a predetermined length; crimping nails 21, 22 which can crimp respectively upper and lower ends of the wrapping paper 11 wound around the stack of coins, and a rotation sensor (not shown) for detecting the rotation of the feed roller 18.

In recent years, in order to improve the efficiency of wrapping, it has been desired to successively wrap a large number of coins with such a coin wrapping machine. However, in the conventional type of coin wrapping machine as described above, the space for accommodating the paper roll 10 has been defined within the housing 7 and, therefore, it has been difficult to ensure a sufficient space for the roll 10, so that the roll 10 that can be accommodated therein is limited to one of relatively small diameter. As a result, it is necessary to frequently replace the paper roll in the case where successive wrapping of a large number of coins is performed. Thus it is substantially impossible to successively wrap a large number of coins with the coin wrapping machine.

In order to successively wrap a large number of coins, another type of coin wrapping machine has been produced and marketed by Brand Inc. as MODEL 1801. This coin wrapping machine has in general the aforementioned arrangement except for having a horizontally extending spindle for carrying a paper roll on a side of housing and a diverter or guide for guiding the wrapping paper into the housing. In this coin wrapping machine, the roll of a desired diameter is attached on the spindle with the axis of the roll oriented horizontally, and the roll is rotatably carried by the spindle. Further, the wrapping paper to be withdrawn from the roll is guided by the diverter toward a feed roller disposed inside the housing.

In this type of coin wrapping machine, when attaching a new roll of wrapping paper, it is required to incline and hold the roll in generally upright attitude and fit the roll on the spindle. However, the roll has a large diameter and heavy weight. For instance, it may be 40 cm in diameter and weigh 10 kg and can not easily maintain its initial shape and, therefore, handling of the roll is troublesome work for the operator. Additionally, when wrapping paper is fed from the roll into the coin wrapping machine by the rotation of the feed roller, slippage may often occur between the feed roller and the wrapping paper which is in contact with the feed roller, because a relatively large tension arises in the wrapping paper between the roll and the feed roller owing to the resistance to rotation of the roll. Thus, the coin wrapping machine would not be able to ensure smooth feeding of the wrapping paper either.

SUMMARY OF THE INVENTION

One object of the present invention is to provide a feeder of wrapping paper for a coin wrapping machine that makes it possible to facilitate the work of replacing the roll of wrapping paper with a new one.

Another object of the present invention is to provide a feeder of wrapping paper for a coin wrapping machine that can feed a wrapping paper smoothly from a roll thereof having a large diameter to the coin wrapping machine.

The foregoing and other objects and advantages are attained, according to the present invention, by a feeder of wrapping paper for a coin wrapping machine, which comprises:

a frame adapted to be placed in position adjacent to the coin wrapping machine;

supporting means for a roll of wrapping paper rotatably mounted on said frame and forming a substantially horizontal plane on which the roll can be placed, said supporting means being provided with a plurality of opening areas for accommodating an operator's fingers supporting a lower side surface of the roll;

driving means for rotating said supporting means;

whereby said supporting means allows the operator's fingers to pass downwardly through said horizontal plane.

Preferred embodiments of the invention may have the following additional features, either alone or in combination:

(1) the supporting means may comprise a turntable generally in the form of a disk plate having an upper surface which forms a horizontal plane larger than the roll in diameter, each of the openings being formed as a cut-away portion in which the roll placed on the turntable is exposed downwardly and the width and depth of which permit the fingers supporting the lower side surface of the roll to pass downwardly therethrough;

(2) the turntable may have at the center of its rotation a vertical shaft to be inserted into a core of the roll;

(3) the frame may be provided with connecting means for fixing the position of the frame relative to the coin wrapping machine;

(4) the frame may have means for adjusting the level thereof;

(5) the frame may have means for covering the roll;

(6) the driving means may comprise a motor for rotating the supporting means and control means for controlling the operation of the motor so that said supporting means is rotated in association with a feed roller constituting coin wrapping means of the coin wrapping machine.

From another aspect, the foregoing and other objects and advantages of the present invention are attained by a feeder of wrapping paper for a coin wrapping machine, which comprises:

a frame adapted to be placed in a position adjacent to a coin wrapping machine;

supporting means for a roll of wrapping paper rotatably mounted on said frame and forming a substantially horizontal plane on which the roll can be placed;

driving means for rotating said supporting means, said driving means including a motor connected with said supporting means and control means for controlling operation of said motor so that said motor causes said supporting means to rotate in association with a feed roller constituting coin wrapping means of the coin wrapping machine.

Preferred embodiments of the invention may have the following additional features, either alone or in combination:

(1) the control means may be adapted to operate the motor so that the supporting means is rotated in synchronism with the feed roller and the wrapping paper is delivered from the roll of wrapping paper at substantially the same velocity as the feeding velocity of the feed roller;

(2) the contol means may include diameter detecting means for detecting the diameter of the roll of wrapping paper and enabling the supporting means to rotate at a speed proportional to the diameter detected by the diameter detecting means;

(3) the diameter detecting means may comprise a detecting lever being adapted to be at one end portion in contact with an outer peripheral surface of the roll on the plane of the supporting means, a rotatable shaft carrying the other end portion of the detecting lever, the rotatable shaft being so biased that the detecting lever is abutted against the surface of the roll, and a potentiometer to detect the rotation of the rotatable shaft;

(4) the control means may have means for detecting a catenary of the wrapping paper which is delivered from the roll of wrapping paper, the control means being adapted to control the operation of the motor in accordance with the catenary of the wrapping paper;

(5) means for guiding the wrapping paper may be provided in the feeder so that the catenary is formed in a predetermined place, the means for detecting the catenary including an optical sensor constituted of a light emitting element and a light receiving element arranged to detect the catenary formed in said place;

(6) measuring means for measuring the running time of said motor and an alarm system actuated when the continuous running time exceeds a predetermined time may be provided in the feeder.

From still another aspect, in order to attain the foregoing and other objects and advantages of the present invention, the present invention provides a method of feeding a wrapping paper for coin wrapping machine, which comprises:

placing a roll of wrapping paper on a rotatable turntable which has a substantially horizontal plane and which is provided with a plurality of opening areas for accommodating an operator's fingers supporting a lower side surface of the roll to allow the fingers to pass downwardly through said horizontal plane;

operating a motor for rotating said turntable in association with a feed roller constituting coin wrapping means of the coin wrapping machine so that no tension is generated in the wrapping paper between the roll and the feed roller.

BRIEF DESCRIPTION OF THE DRAWINGS

The above and other objects, advantages and novel features of the present invention will be more fully apparent from a reading of the following detailed descriptions taken in conjunction with the accompanying drawings in which.

DESCRIPTION OF THE PREFERRED EMBODIMENT

In FIGS. 1, 2, 2A and 3, an embodiment of a feeder of wrapping paper in accordance with the present invention is shown together with a coin wrapping machine.

Figure 1:
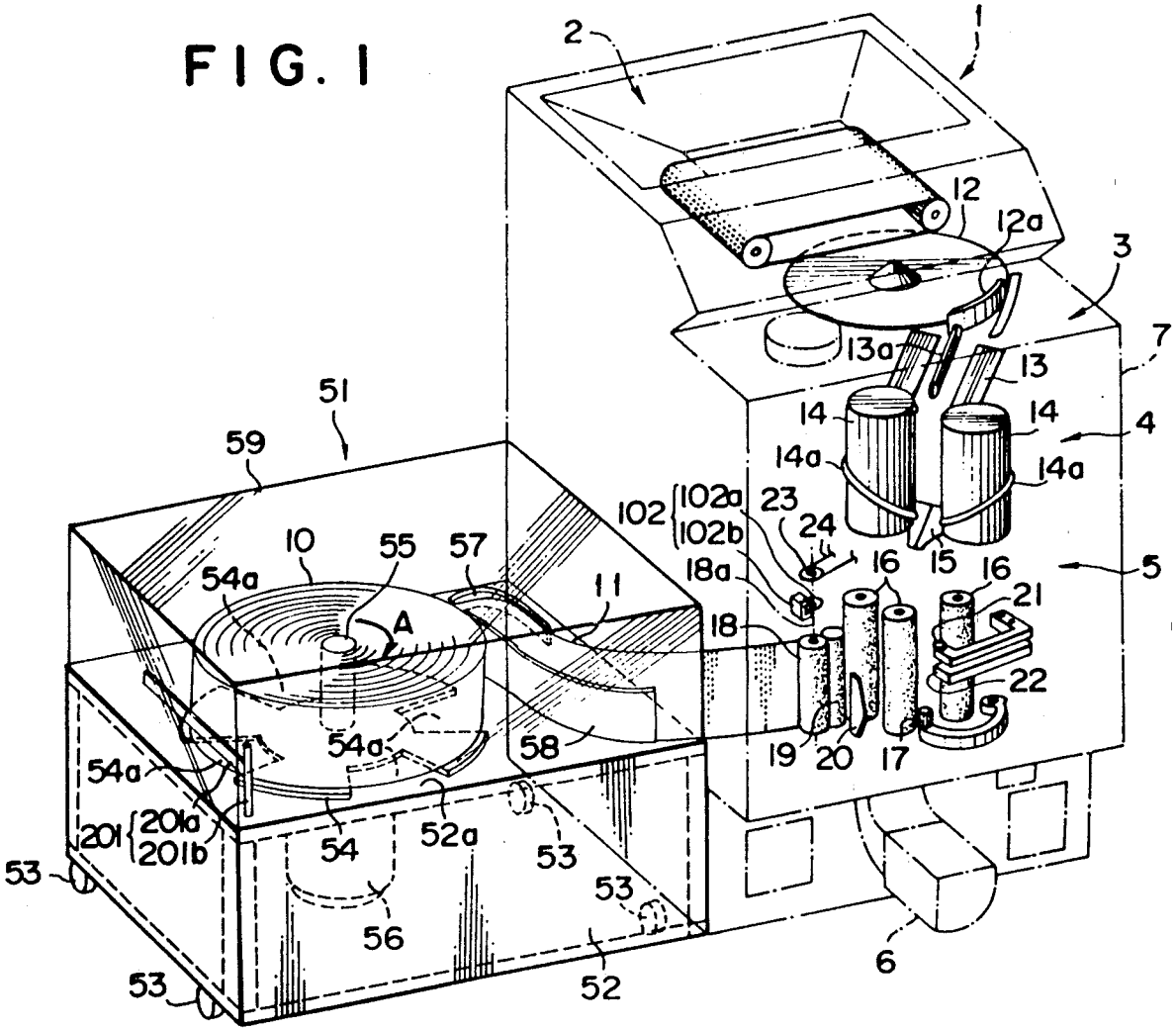
FIG. 1 is a schematic perspective view showing an embodiment of a feeder of wrapping paper in accordance with the present invention together with a coin wrapping machine.

Referring to FIG. 1, there are shown a coin wrapping machine 1 which stacks a plurality of coins in the form of a cylinder or roll and winds a wrapping paper around the stacked coins to package them, and a feeder of wrapping paper 51 which is placed on one side of the coin wrapping machine 1 in a position adjacent thereto and which is arranged to feed a wrapping paper 11 into the coin wrapping machine 1.

The coin wrapping machine 1 comprises a hopper 2 into which coins are thrown, a discriminating and counting device 3 which discriminates, on the basis of differences in thickness and diameter among denominations, only a predetermined denomination of coins from among the coins thrown into the hopper 2 and which counts and successively delivers the discriminated coins; a stacking device 4 which stacks the coins delivered from the discriminating and counting device 3 to make a stack of a predetermined number of coins in the form of a cylinder or roll; a wrapping device 5 which winds the wrapping paper around the stack of coins made by the stacking device 4 to wrap the stack in the paper; a chute 6 which delivers the wrapped coins, that is, a roll of coins, outside of the coin wrapping machine 1; and control unit (not shown) which controls the operation of these devices, that is, the discriminating and counting device 3, the stacking device 4, and the wrapping device 5. These devices are included in a housing 7 as shown in phantom lines.

The discriminating and counting device 3 has a rotatable disc 12 which receives the coins thrown through the hopper 2 on its upper side surface. The rotatable disc 12 is adapted to be rotated for transfering the coins circumferentially and outwardly by the centrifugal force caused by its rotation and is provided with a thickness limiting member 12*a*, which permits only the coins having a thickness smaller than a predetermined thickness to pass successively therethrough, thereby taking out only such coins. The discriminating and counting device 3 also has a coin discriminating passageway 13 and a conveyor belt 13*a*. The coin discriminating passageway 13 is arranged to guide only the coins having a diameter larger than a predetermined diameter, and the conveyor belt 13*a* is adapted to take over the coins which have been delivered from the rotatable disc 12 and conveys them along the coin discriminating passageway 13. The discriminating and counting device 3 further includes a count sensor (not shown) for counting the coins guided and conveyed along the coin discriminating passageway 13, and a stop (not shown) for temporarily blocking the coins when a predetermined number thereof has been counted.

The stacking device 4 has a pair of stacking drums 14,14, which are adjustable in the clearance therebetween in accordance with the denomination of the coins and adapted to be driven in rotation about their vertical axes in opposite directions relative to each other. On outer peripheral surface of each of the stacking drums 14,14, there is provided a spiral guide 14*a*, which supports the coins delivered through the discriminating and counting device 3 with the coins being stacked vertically. The stacking device 3 also has a shutter 15 which is opened after a predetermined number of coins are stacked. The stacking device 4 is arranged to rotate the stacking drums 14,14 by the angle required for the coin denomination every time when one of the coins is fed to the spiral guides 14*a*,14*a*. Therefore, the portion of each of the spiral guides 14*a*,14*a* supporting the coins is lowered gradually and, thereby, the stacking device 4 allows the spiral guides 14*a*,14*a* to be lowered intermittently so that the upper end of the stack thereon is normally positioned on a level with the upper surface of the coin discriminating passageway 13. When the predetermined number of coins has been thus stacked, the stacking device 4 allows the stack to be lowered onto the shutter 15.

The wrapping device 5 includes wrapping rollers 16,16,16, which are rotated about their vertical axes and are adjustable in the clearance therebetween in accordance with the denomination of the coins to be wrapped, and a coin carrier 17 which is moved upwardly and downwardly in a space among the wrapping rollers 16,16,16 so as to receive the stack falling through the shutter 15 upon its opening and to guide the stack to the wrapping position. The wrapping device 5 also includes a feed roller 18 which is rotated about its vertical axis and which feeds a wrapping paper withdrawn from a roll of wrapping paper, namely a paper roll 10 between the wrapping rollers 16,16,16 and the stack located in the wrapping position; an idler roller 19 which is disposed to cooperate with the feed roller 18 to grasp the wrapping paper 11; a cutter 20 which can cut the wrapping paper at a desired place thereof when the wrapping paper 11 has been fed a predetermined length; crimping nails 21,22 which can crimp respectively upper and lower ends of the wrapping paper 11 wound around the stack of coins, and a rotation sensor 102 for detecting the rotation of the feed roller 18.

Each wrapping roller 16 is connected with a wrapping motor (not shown) by means of a gear train (not shown), and it is adapted to be rotated at a relatively high speed by the motor so as to wind the wrapping paper 11 around the stack of coins after the wrapping paper 11 is fed by the predetermined length.

The feed roller 18 has a shaft 18*a* as shown in a phantom line, to which a pulley 23 is secured at an upper end portion. The pulley 23 is operatively connected by means of an endless belt 24 with a feed motor (not shown), which is driven at a relatively low speed when the wrapping paper 11 is to be fed by the feed roller 18.

The shaft 18*a* has a plate-shaped rotor 102*a* fixed thereon, and a sensor part 102*b* is disposed opposite thereto for counting slits (not shown) formed on the rotor 102*a*. The rotor 102*a* and the sensor part 102*b* together constitute a rotation sensor 102 for detecting the rotation of the feed roller 18.

The wrapping device 5 further includes guide plates 25,26,27,28 for guiding the wrapping paper 11 which is fed from the feeder of wrapping paper 51 through an opening 29 formed in one side of the housing 7. The guide plates 25,26 are arranged to direct the wrapping paper 11 into a nip between the feed roller 18 and the idler roller 19. The guide plates 25,26 is so formed that the wrapping paper 11 is spaced apart from the guide plates 25,26 when the wrapping paper 11 is withdrawn along a desired path by the feed roller 18, and that the wrapping paper 11 is prevented from deflecting from the path when the wrapping paper 11 tends to be greatly distorted so as to deflect from the path. Further, the guide plate 27 is arranged to prevent the wrapping paper 11 from being wound on the feed roller 18 and to direct the wrapping paper 11 delivered from the feed roller 18 toward a forward area of a cutting edge of the cutter 20, and the guide plate 28 is arranged to deflect the wrapping paper 11 at the area toward a space formed among the wrapping rollers 16,16,16.

Figure 2:
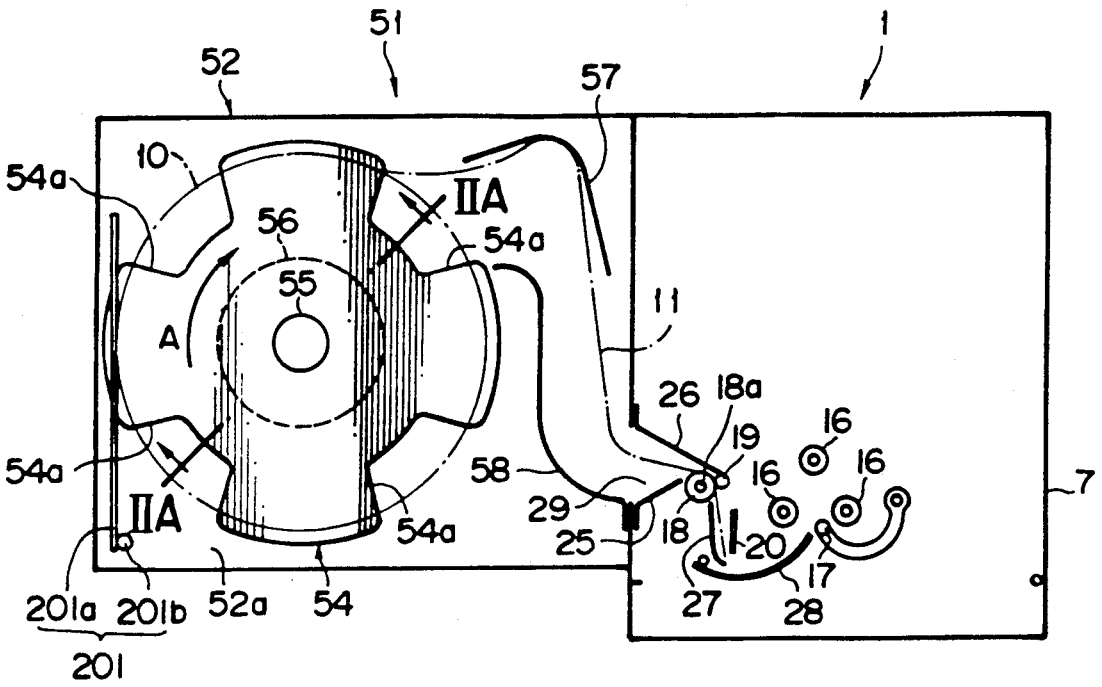
FIG. 2 is a schematic plan view of the feeder and the coin wrapping machine shown in FIG. 1.

The feeder of wrapping paper 51 is located adjacent to the coin wrapping machine and comprises a frame 52 having a plurality of casters 53 for transport of the frame 52; a turntable 54 mounted on the frame 52 and having at the center thereof a vertical shaft 55 to be inserted into a hollow or hole formed in a core of the paper roll 10; an electric motor 56 positioned within the frame 52 for rotating the turntable 54; and guide plates 57,58 for guiding the wrapping paper 11 along a predetermined path. As shown in FIG. 2, the wrapping paper 11 is deflected with a curved surface of the guide plate 57 to extend toward the guide plate 58 and further, is curved with the paper 11 being withdrawn by the feed roller 18 before reaching a curved surface of the guide plate 58 to extend through the opening formed on the housing 7 of the coin wrapping machine 1.

The feeder of wrapping paper 51 has a controller (not shown) for controlling the operation of the electric motor 56 and a diameter sensor 201 for detecting the diameter of the paper roll 10. The diameter sensor 201 includes a detecting lever 201*a*, which extends horizontally with its one end portion in contact with the outer periphery of the roll 10 on the turntable 54, and a rotatable shaft 201*b* carrying the other end portion of the detecting lever 201*a*. The rotatable shaft 201*b* is biased clockwisely as seen in FIG. 2 so that its distal end is abutted against the periphery of the roll 10. The diameter sensor 201 also includes a potentiometer (not shown) to which the shaft 201*b* is connected.

Figure 2A:
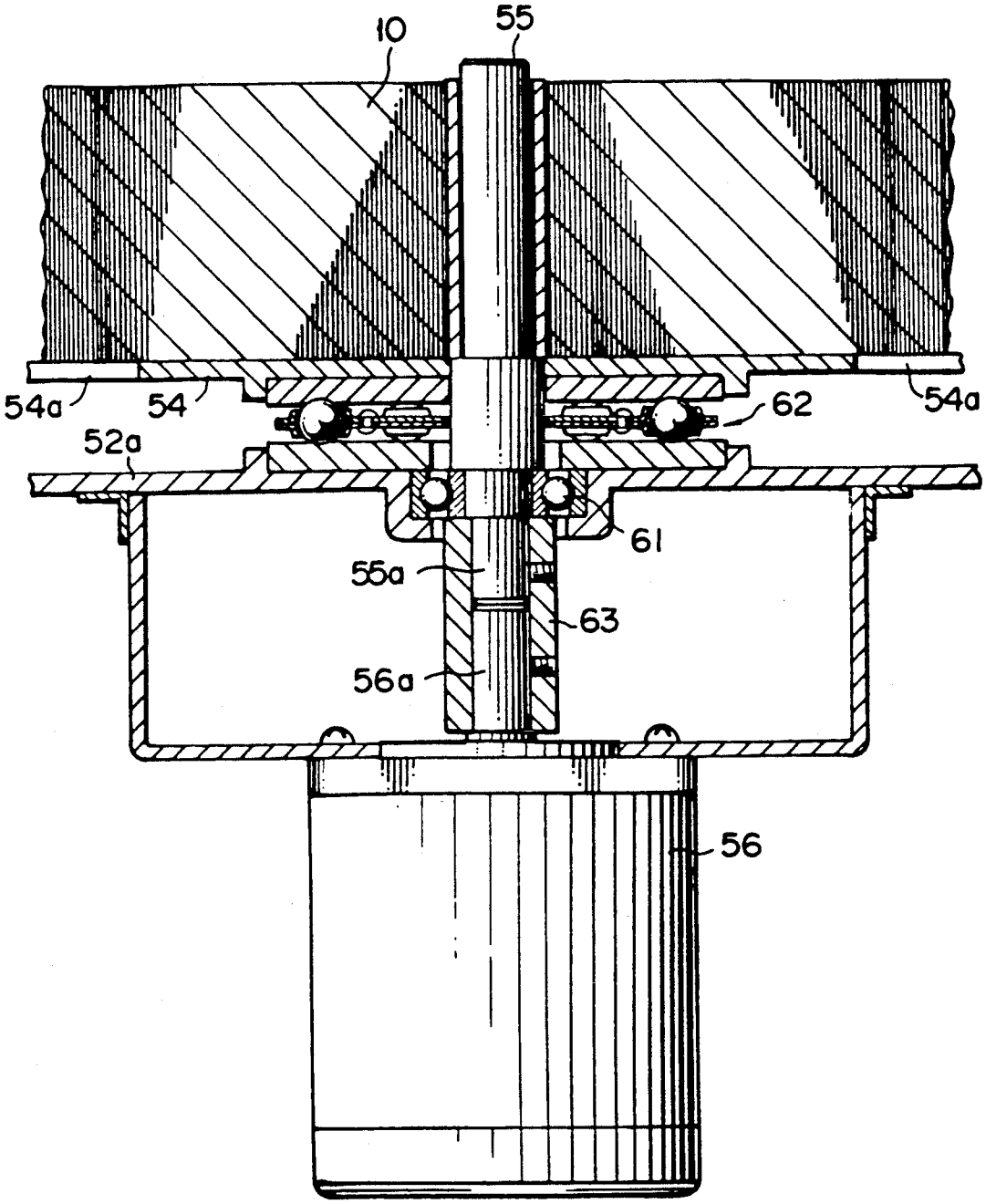
FIG. 2A is a partial, vertical cross-sectional view of the feeder taken along line IIa—IIa of FIG. 2.

The frame 52 defines a generally box-like casing, and a top plate 52*a* constituting a part of the frame 52 carries the turntable 54. As shown in FIG. 2A, a lower portion 55*a* of the shaft 55 extends downwardly from the turntable 54, and is mounted rotatably by means of a radial bearing 61 on the top plate 52*a*. Further, the lower surface of the turntable 54 is supported by means of a thrust bearing 62 with the turntable 54 being lifted off from the top plate 52*a*. The lower portion 55*a* of shaft 55 is connected to the electric motor 56 by means of a fitting 63 shown schematically.

As shown in FIG. 1, the frame 52 may be provided with a cover 59 for preventing the wrapping paper 11 from being affected by air currents and so forth in the atmosphere. The cover 59 may be made of, for example, transparent acrylic plates. The cover 59 is hingedly mounted on one of the side edges of the top plate 52*a* and has a cut out (not shown) for allowing the wrapping paper 11 to pass therethrough, in a position corresponding to the opening 29 of the housing 7. In order to compensate for any vertically offset caused by inclination or irregularity of the floor or the like, the frame 52 preferably has a leveling mechanism, such as adjusters, which are interposed between the bottom plate of the frame 52 and each of casters 53. Further, the frame 52 may be provided with connectors, for example, bolts, which connect the frame 52 with the housing 7 for fixing the position of the frame 52 relative to the coin wrapping machine 1.

The turntable 54 is generally in the form of a disk and has an upper surface for placing thereon the roll 10, which surface defines a horizontal plane having a diameter slightly larger than the roll of wrapping paper 10 which is too large in diameter to be accommodated in the housing 7 of the coin wrapping machine 1. The roll 10 placed on the turntable 54 is centered on the axis of the rotation thereof by the vertical shaft 55, and rotated with the rotation of the turntable 54 by the electric motor 56, as shown by an arrow A, so that the roll 10 delivers the wrapping paper 11 successively.

Further, the turntable 54 has, in its outer periphery, four cut-away portions 54*a*,54*a*,54*a*,54*a* defining opening areas which are circumferentially spaced at equal distances apart from each other and which extend radially and inwardly over the outer periphery of the roll 10. At each cut-away portion 54*a*, the lower side surface of the roll 10 is exposed downwardly without contacting with the upper surface of the turntable 54. Each of the cut-away portions 54*a* has a size (width and depth) which permits the operator to place the roll 10 onto the turntable 54 by holding the roll 10 in his hand with his fingers beneath it and then passing his fingers downward through the cut-away portions 54*a* as he lowers it onto the turntable 54. In the case where the diameters of the roll 10 and the turntable 54 are, for example, approximately 40 cm and 43 cm respectively, the width and depth may be set to be, for example, approximately 15 cm and 7 cm, respectively.

Figure 3:
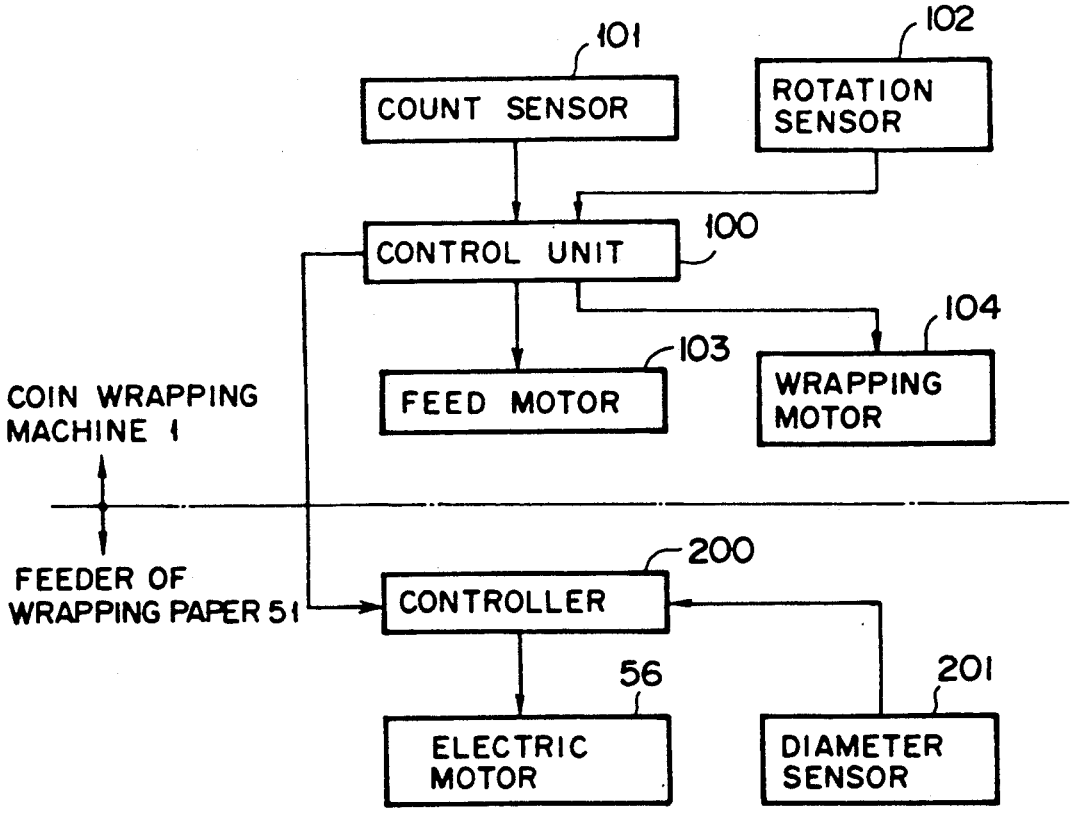
FIG. 3 is a block diagram of control systems of the feeder and the coin wrapping machine shown in FIG. 1.

Now, referring to FIG. 3, in the coin wrapping machine 1, signals from the count sensor 101 and the rotation sensor 102 are inputted to the contol unit 100. The count sensor 101 is an optical or magnetic sensor arranged to count the coins passing along the coin discriminating passageway 13, and the rotation sensor 102 is, as described above, arranged to detect the rotation of the feed roller 18.

The control unit 100 integrates the amount of rotation of the feed roller 18 on the basis of the signal from the rotation sensor 102, thereby figuring out the length of the wrapping paper 11 which has been fed by the feed roller 18. The control unit 100 also controls operation of the feed motor 103 which drives the endless belt 24 connected with the feed roller 18, in such a manner that the feed motor 103 is started when the predetermined number of coins has been counted by the count sensor 101 and therefore, when the stacking operation of the desired number of coins is recognized to have been accomplished in the stacking device 4. Further, the control unit 100 stops the operation of the feed motor 103 as it discerns on the basis of the signal from the rotation sensor 102 that the predetermined length of the wrapping paper 11 has been fed. In association with these operations, the control unit 100 allows the shutter 15 to operate by means of the driving mechanism (not shown) such that the stack of coins on the shutter 15 is passed over to the coin carrier 17, and further, allows the coin carrier 17 to work so that the stack of coins thereon moves into wrapping position among the wrapping rollers 16,16,16, and then allows the wrapping rollers 16,16,16 to grasp the wrapping paper 11 in cooperation with the stack. Still further, the control unit 100 starts the wrapping motor 104 to rotate the wrapping rollers 16,16,16 so as to wind the wrapping paper 11 around the stack.

The control unit 100 is connected to controller 200 of the feeder 51, preferably, by means of a connector which is readily engageable and disengageable, and inputs into the controller 200 operation control signals for the electric motor 56, which correspond to operative and inoperative conditions of the feed motor 103. On the basis of these signals, the controller 200 controls operative and inoperative conditions of the electric motor 56.

Further, position signals indicating positions, that is signals from the potentiometer indicating the rotation angle of the rotatable shaft 201*b* of the diameter sensor 201, are inputted into the controller 200. The controller 200 discerns the actual diameter of the roll 10 on the basis of the positon signal and permits the electric motor 56 to be driven at a proper speed in accordance with the diameter of the roll 10 in such a manner that the smaller the diameter is, the higher the rotation speed of the turntable 54 is, that is, the delivery velocity of the wrapping paper 11 is kept constantly at a predetermined rate. The predetermined rate is set to correspond to the feeding velocity of the wrapping paper 11 in the feed roller 18 and thus, the electric motor 56 is operated in synchronism with the operation of the feed motor 103 so that no tension is caused in the wrapping paper 11 extending between the feed roller 18 and the roll 10.

The coin wrapping machine 1 and the feeder of wrapping paper 51 thus arranged are operated in a manner as described hereinafter.

As the coin wrapping machine 1 positions the stack of coins between the wrapping rollers 16,16,16 in the aforementioned manner, the control unit 100 allows the feed motor 103 to operate so that the feed roller 18 feeds the wrapping paper 11 around the stack. Simultaneously, the control unit 100 inputs the operation signal into the controller 200 in the feeder of wrapping paper 51, and the feeder 51 allows the electric motor 56 to rotate the turntable 54 at a desired speed proportional to the diameter of the roll 10, whereby the wrapping paper 11 is delivered, generally in a tangential direction from the roll 10 at a delivery velocity set to be substantially the same as the feeding velocity of the feed roller 18. The wrapping paper 11 is brought into sliding contact with the guide plate 57 to be deflected along the surface thereof toward the guide plate 58, and is withdrawn through the cutout of the cover 59 and the opening 29 by the feed roller 18 before reaching the guide plate 58, and further, the wrapping paper 11 is fed through the feed roller 18 between the stack of coins and the wrapping rollers 16,16,16.

As the control unit 100 discerns on the basis of the signal from the rotation sensor 102 that the predetermined length of the wrapping paper 11 required for wrapping the stack of coins has been fed through the feed roller 18, it causes the feed motor 103 to stop and inputs the operation signal indicating an inoperative condition to the controller 200 for stopping the electric motor 56. Then, the controller 100 causes the wrapping motor 104 to operate so as to wind the wrapping paper 11 around the stack with the wrapping rollers 16,16,16 and cut the wrapping paper 11. Further, the wrapping paper 11 which has been wound around the stack is crimped at its upper and lower end portions by the crimping nails 21,22, respectively. This completes the wrapping operation.

After the wrapping operation is finished, the coin wrapping machine 1 causes a driving mechanism (not shown) to swing the coin carrier 17 so as to deliver the wrapped coins, that is the roll of coins, through the chute 6 to the outside of the coin wrapping machine 1. The coin wrapping machine 1 repeats the operations described above in response to incoming coins.

When the roll 10 is to be replaced with a new roll of wrapping paper after all of the wrapping paper 11 has been substantially consumed for coin wrapping, the operator places the new roll onto the turntable 54, inserting the vertical shaft 55 thereof through the core of the new roll. At this time, the operator can place the lower side surface of the new roll onto the upper surface of the turntable 54 without releasing his fingers from the new roll, that is, without pulling his fingers out of the space between the new roll and the turntable 54 while lowering it, because he can pass his fingers downwardly through the horizontal plane defined by the upper surface of the turntable 54, i.e. downwardly through the cut portion 54*a* thereof, while holding the new roll.

As explained hereinbefore, in this embodiment, the feeder of wrapping paper 51 has the turntable 54 on which the roll of wrapping paper 10 can be placed and which is rotated by the electric motor 56, and the motor 56 is driven in synchronism with the operation of the feed motor 103 on the basis of the operation signal from the controller 100 so that no tension is generated in the wrapping paper 11 between the roll 10 and the feed roller 18. Therefore, the feeder 51 can smoothly feed the wrapping paper 11 from the roll 10 of large diameter into the coin wrapping machine 1 without causing slippage between the wrapping paper 11 and the feed roller 18.

Further, in the feeder 51, since the turntable 54 is provided with the cut portions 54*a*,54*a*,54*a*, 54*a* through which the operator's fingers can pass downwardly, the operator can securely hold the new roll as he lowers it onto the turntable 54 when replacing a consumed roll, until the new roll has been fully placed on the upper surface of the turntable 54.

Thus, according to this embodiment, there is realized a feeder of wrapping paper, which is capable of smooth feeding of the wrapping paper from a roll thereof having a large diameter without greatly changing the design of the coin wrapping machine or remodeling the machine on a large scale and which can facilitate an oprerator's handling rolls of wrapping paper.

Figure 4:
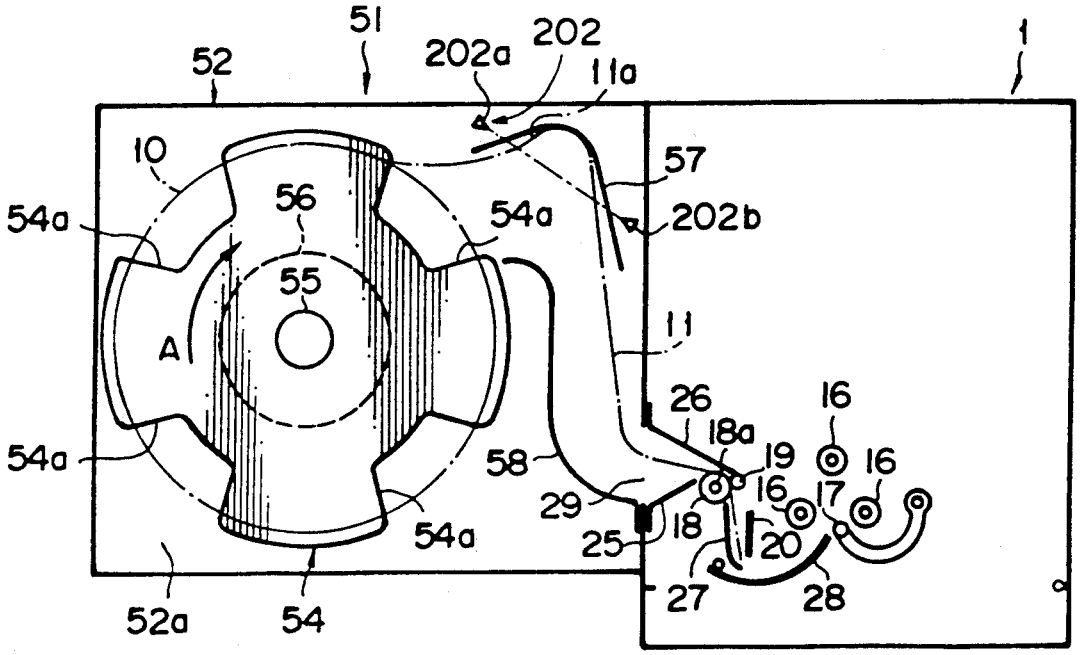
FIG. 4 is a schematic plan view showing another embodiment of a feeder of wrapping paper in accordance with the present invention together with a coin wrapping machine.
Figure 5:
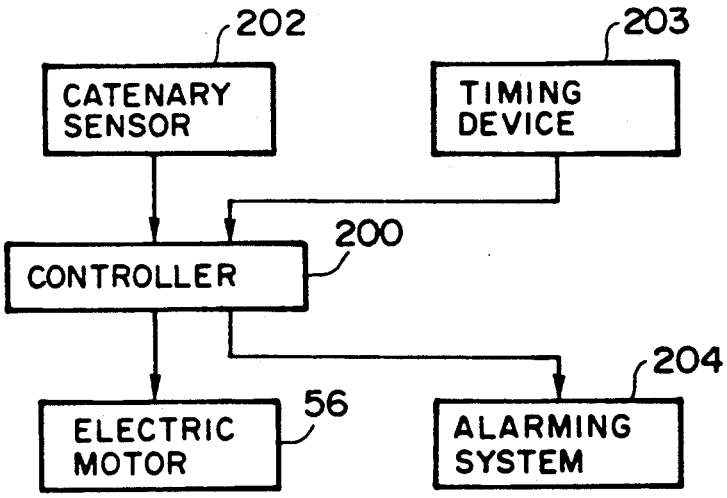
FIG. 5 is a block diagram of control systems of the feeder and the coin wrapping machine shown in FIG. 4.
Figure 6:
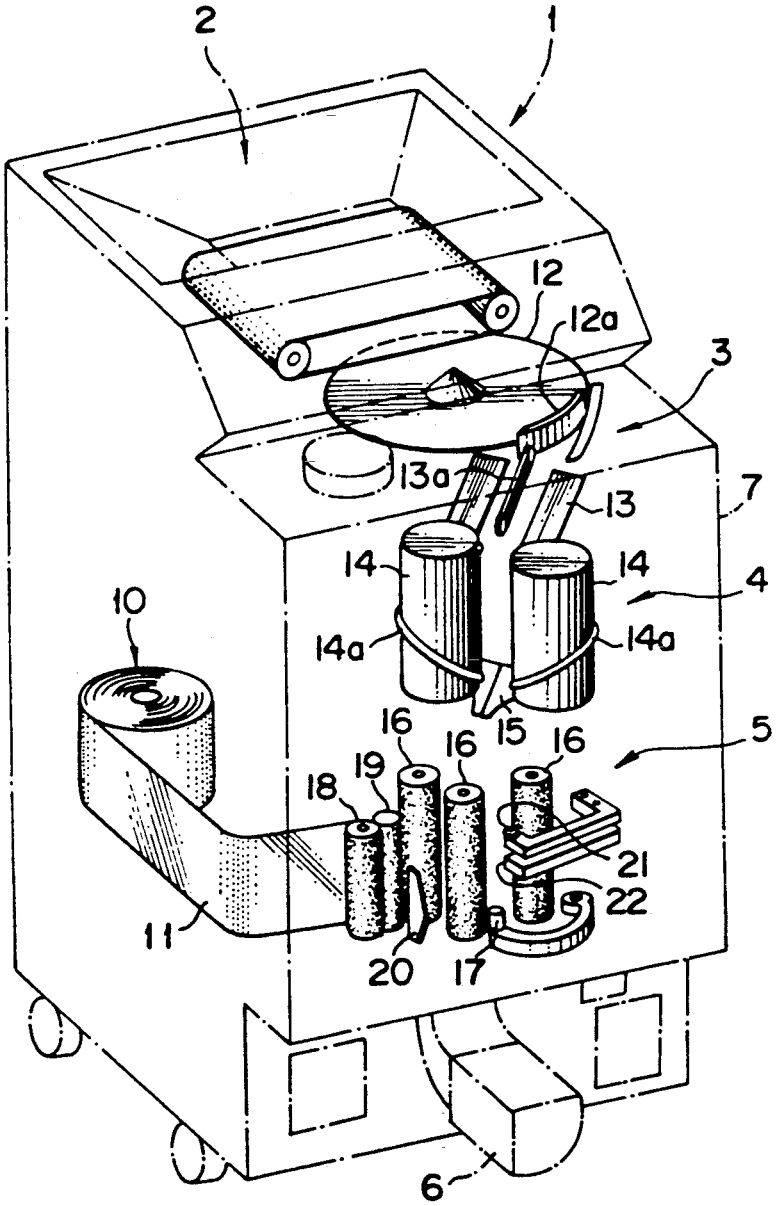
FIG. 6 PRIOR ART
FIG. 6 is a schematic perspective view showing a conventional coin wrapping machine.

Referring to FIGS. 4 and 5, there is shown a feeder of wrapping paper according to another embodiment of the present invention. In the FIGS. 4 and 5, devices and members similar to the devices and members shown in FIGS. 1 to 3 are indicated by similar reference numerals.

In the embodiment shown in FIGS. 4 and 5, the feeder of wrapping paper 51 has substantially the same arrangement as the feeder shown in FIGS. 1 to 3 and, therefore, the feeder 51 is provided with a turntable 54 having a plurality of cut portions 54*a*, which allow the fingers of an opperator holding a new roll of wrapping paper to pass downwardly therethrough when the operator places the roll onto the turntable 54. However, in this embodiment, the feeder 51 has a catenary sensor 202 used for controlling the rotation of the turntable 54, which sensor detects a catenary or bulge of the wrapping paper 11 formed in a place where the wrapping paper 11 is deflected by a guide plate 57. The catenary sensor 202 includes a light emitting element 202*a* and a light receiving element 202*b* positioned at opposite ends of the phantom straight line shown in FIG. 4. The catenay sensor 202 detects any bulged portion of the wrapping paper 11, that is, it detects the catenary portion 11*a*.

Further, as shown in FIG. 5, the feeder 51 is provided with a controller 200 for controlling the electric motor 56. The result of the detection by catenary sensor 202 and the measurement result of a timing device 203 are inputted to the controller 200, The timing device 203 can be defined by a timer which measures the running time of the electric motor 56. On the basis of the result detected by the catenary sensor 202, the controller 200 prevents the electric motor 56 from operating so long as the catenary portion 11*a* is detected by the catenary sensor 202. On the other hand, the electric motor 56 is operated to rotate the turntable 54 so long as the catenary portion 11*a* is not detected by the catenary sensor 202.

The controller 200 is also adapted to decide according to the measurement result of the timing device 203 whether the wrapping paper 11 has been completely used up and whether any problem, such as jamming has arisen in connection with the wrapping paper 11. When the continuous running time of the electric motor 56 measured by the timing device 203 exceeds a predetermined time, the controller 200 decides that the wrapping paper 11 has been used up or jummed, and actuates a buzzer or alarm lamp of an alarm system 204 provided in the feeder 51, which system informs the operator of the need to insert a new roll of wrapping paper or of occurrence of trouble in the feeder 51.

In the feeder of wrapping paper 51 of this embodiment, when the wrapping paper 11 is fed into a space between a stack of coins and wrapping rollers 16,16,16 and the catenary portion 11*a* disappears, the controller 200 can discern this disappearance through the catenary sensor 202. Then, the controller 200 causes the electric motor 56 to rotate the turntable 54, so that the wrapping paper 11 is delivered from the roll 10. As a result, the wrapping paper 11 is bulged toward the guide plate 57 to form the catenary portion 11*a* again. As the controller 200 discerns the appearance of the catenary portion 11*a* through the catenary sensor 202, the controller 200 causes the electric motor 56 to stop so as not to rotate the turntable 54. The electric motor 56 repeats such an operation and therefore, the catenary portion 11*a* repeatedly appears and disappears, whereby a proper catenary of the wrapping paper 11 in an area around the guide plate 57 is ensured. Thus, since the rotation of the turntable 54 is so controlled that no tension is imparted to the wrapping paper 11, slippage between the wrapping paper 11 and the feed roller 18 is prevented.

Further, the feeder 51 can operate the electric motor 56 in association with the rotation of the feed roller 18 without detecting the operating condition of any devices in the coin wrapping machine 1 and, therefore, no wiring is necessary between the feeder 51 and the coin wrapping machine 1. Thus, according to this embodiment, a modifications in the design of the coin wrapping machine or remodeling of the structure of the machine can be minimized. Therefore, the feeder provides advantages especially when the feeder is installed to for use with an existing coin wrapping machine.

As described above with reference to the preferred embodiments, according to the present invention, it is possible to provide a feeder of wrapping paper for a coin wrapping machine which can smoothly feed a wrapping paper to the coin wrapping machine from a roll of wrapping paper having a large diameter, and which can facilitate the work of replacing the roll with a new roll of wrapping paper.

The present invention has thus been shown and described with reference to specific embodiments. However, it should be noted that the present invention is in no way limited to the details of the described arrangements but changes and modifications may be made without departing from the scope of the appended claims.

For example, in the above embodiments, although the electric motor 56 is controlled by the controller 200 provided in the feeder of wrapping paper 51, it is possible to control the electric motor 56 with the control unit 100 of the coin wrapping machine 1.

Further, in the above embodiments, the turntable 54 has the cut-away portions 54*a* for downward passage of the operator's fingers which hold on a lower side surface of the roll downwardly, the turntable may instead be provided with recesses for accommodating the fingers and allowing the operator to remove the fingers laterally therefrom.

Still further, it is possible to modify the shape, size layout and structure of the frame, the turntable, and the cut-away portions.

We claim:

1. A feeder of wrapping paper in the form of a tape for a separate coin wrapping machine having a feed roller and a wrapping mechanism therein, the feed roller being driven to feed the wrapping paper to the wrapping mechanism, the wrapping mechanism winding the wrapping paper around the coins, which comprises:

tape supporting means for a large heavy disk-roll of wrapping paper for providing a rotatable substantially horizontal plane, of greater extent than the diameter of the roll, on which the roll can be placed with a central core of the roll extending vertically and a lower flat side of the roll in contact with the plane, said plane having a plurality of opposed opening areas extending from the outer periphery of the roll radially inward for accommodating an operator's fingers when the operator, grasping opposite edges of the roll with fingers extending under the lower side surface of the roll, places the roll on the plane for allowing the operator's fingers to pass downwardly through said horizontal plane to prevent pinching the operator's fingers and prevent dropping the roll;

frame means for rotatively supporting the tape supporting means and for positioning the tape support means adjacent to the separate coin wrapping machine;

tape driving means for rotating said supporting means to rotate the roll in association with operation of the feed roller for preventing tension in the paper tape fed to the feed roller;

tape sensor means for detecting a position of a surface of the paper tape and generating a signal;

tape tension control means for controlling the tape driving means dependent on the signal of the tape sensor means for preventing tension in the paper tape fed to the feed roller.

2. A feeder of wrapping paper according to claim 1 wherein said supporting means includes a disk-like turntable having an upper surface which forms said horizontal plane with a diameter larger than the roll, each of said openings is a cut-away portion to which the lower side of the roll placed on the turntable is exposed downwardly and the width and depth of which permit the fingers supporting the lower side surface of the roll to pass downwardly therethrough.

3. A feeder of wrapping paper according to claim 2 wherein said turntable has at the center of its rotation a vertical shaft to be inserted into a core of the roll.

4. A feeder of wrapping paper according to claim 2 wherein said frame is provided with connecting means for fixing the position of said frame relative to the separate coin wrapping machine.

5. A feeder of wrapping paper according to claim 2 wherein said frame has means for adjusting the level thereof.

6. A feeder of wrapping paper according to claim 2 wherein said frame has means for covering the roll.

7. A feeder of wrapping paper according to claim 1 wherein said driving means comprises a motor for rotating said supporting means and the tape tension control means is for controlling operation of said motor so that said supporting means is rotated depending on a signal indicating operation of the feed roller for preventing tension in the paper tape fed to the feed roller.

8. A feeder of wrapping paper in the from of a tape for a separate coin wrapping machine having a feed roller and a wrapping mechanism therein, the feed roller being driven to feed the wrapping paper to the wrapping mechanism, the wrapping mechanism winding the wrapping paper around the coins, and the wrapping machine including detecting means for detecting and providing a signal for indicating the operation of said feed roller, which comprises:

tape supporting means for a large heavy disk-like roll of wrapping paper for providing a rotatable substantially horizontal plane, of greater diameter than the diameter of the roll, on which the roll can be placed with a central core of the roll extending vertically and a lower flat side of the roll in contact with the plane;

frame means for rotationally supporting the tape supporting means and for positioning the tape support means adjacent to the separate coin wrapping machine;

tape driving means for rotating said supporting means and including a motor connected with said supporting means for preventing tension in the paper tape fed to the feed roller;

tape sensor means for detecting a position of a surface of the paper tape and generating a signal; and tape tension control means for controlling operation of said motor to rotate the roll dependent upon the signal of the sensor means and upon said signal from said detecting means of the separate coin wrapping machine indicating operation of said feed roller for preventing tension in the paper fed to the feed roller.

9. A feeder of wrapping paper according to claim 8 wherein said control means receives a signal from said separate coin wrapping machine indicating feed roller operation and said control means operates said motor to rotate said tape supporting means in synchronism with the feed roller for delivering the wrapping paper from the roll at substantially the same velocity as the feed velocity of the feed roller for preventing tension in the tape fed to the feed roller.

10. A feeder of wrapping paper according to claim 8 wherein said sensor means for detecting the position of the paper tape surface includes diameter detecting means for detecting the diameter of the roll of wrapping paper and for controlling rotation of said supporting means to rotate at a speed proportional to the diameter detected by the diameter detecting means for preventing said tension.

11. A feeder of wrapping paper according to claim 10 wherein said diameter detecting means comprises a detecting lever being adapted to be at one end portion in contact with an outer peripheral surface of the roll on said plane, a rotatable shaft carrying the other end portion of the detecting lever, the rotatable shaft being so biased that said detecting lever is abutted against the surface of the roll, and a potentiometer to detect the rotation of said rotatable shaft.

12. A feeder of wrapping paper according to claim 8 wherein said sensor means has means for detecting a horizontal catenary of the wrapping paper which is delivered from the roll of wrapping paper, said control means being adapted to control the operation of said motor in accordance with the catenary of the wrapping paper which is detected by said means for detecting the catenary.

13. A feeder of wrapping paper according to claim 12 further comprising means for guiding the wrapping paper so that the horizontal catenary is formed in a predetermined place, said means for detecting the catenary including an optical sensor which is constituted of a light emitting element and a light receiving element arranged to detect the catenary formed in said place.

14. A feeder of wrapping paper according to claim 8 further comprising measuring means for measuring the running time of said motor and an alarm system actuated when the continuous running time exceeds a predetermined time.

15. A feeder of wrapping paper according to claim 8 wherein said supporting means includes a disk-like turntable having an upper surface which forms said horizontal plane with a diameter larger than the diameter of the roll, said turntable having a plurality of cut-away portions extending from the outer periphery of the roll radially inward to which the lower side of the roll placed on the turntable is exposed downwardly and the width and depth of which permit an operator's fingers to pass downwardly therethrough when the operator, grasping opposite edges of the roll with fingers extending under the roll for supporting the lower side surface of the roll places the roll on the turntable to prevent pinching the operator's fingers and prevent dropping of the roll.

16. A method of feeding a wrapping paper in the form of a tape for a separate coin wrapping machine having a feed roller and a wrapping mechanism therein, the feed roller being driven to feed the wrapping paper to the wrapping mechanism, the wrapping mechanism being arranged to wind the wrapping paper fed by the feed roller around the coins, which comprises the steps:

positioning a frame adjacent to the separate coin wrapping machine;

rotatively mounting a turntable on the frame for providing a substantially horizontal plane of greater extent than the diameter of a large heavy disk-like roll of wrapping paper and providing a plurality of opposed opening areas extending from an outer periphery of the roll radially inwardly for accommodating an operator's fingers supporting a lower side surface of the roll;

providing a motor to rotate said turntable with respect to said frame;

loading a large heavy roll of wrapping paper in the turntable by grasping opposite edges of the roll with the finger extending around along the bottom of the roll to support the roll, lowering the roll so that the fingers travel downwardly through the opening areas of said horizontal plane as the roll is placed on the plane with a central core extending vertically, releasing the roll, and feeding a free end of the roll into the coin wrapping machine;

detecting and providing a signal for indicating the operation of said feed roller, detecting the posistion of a surface of the paper tape and generating a signal for indicating the position; and operating the motor for rotating the roll on said turntable depending on said signals indicating operation of said feed roller and the position of the tape surface to prevent tension in the wrapping paper between the roll and the feed roller.

17. A method of feeding a wrapping paper acoording to claim 16 wherein said motor rotates in synchronism with the feed roller and the wrapping paper is delivered from the roll of wrapping paper at substatially the same velocity as the feeding velocity of the feed roller.

18. A method of feeding a wrapping paper according to claim 16 wherein a horizontal catenary of the wrapping paper which is delivered from the roll of the wrapping paper is detected at a predetermined position and the operation of said motor is so controlled that the presence of the predetermined horizontal catenary is ensured between the roll and the feed roller.

* * * * *